US005264158A

United States Patent [19]

Stern

[11] Patent Number: 5,264,158

[45] Date of Patent: Nov. 23, 1993

[54] AQUEOUS BASED CLEANER-DEGREASER

[75] Inventor: Theodore R. Stern, Minneapolis, Minn.

[73] Assignee: Circuit Research Corporation, Delano, Minn.

[21] Appl. No.: 853,051

[22] Filed: Mar. 18, 1992

[51] Int. Cl.[5] ..... C11D 1/22; C11D 1/78; C11D 1/72; C11D 11/00

[52] U.S. Cl. ..... 252/525; 252/539; 252/540; 252/139; 252/173; 252/174.16; 252/DIG. 17

[58] Field of Search ..... 252/525, 539, 540, 139, 252/173, 174.16, DIG. 17

[56] References Cited

U.S. PATENT DOCUMENTS

| | | | |
|---|---|---|---|
| 2,531,166 | 11/1950 | Shaw | 252/540 |
| 3,507,798 | 4/1970 | Egan | 252/540 |
| 4,222,905 | 9/1980 | Cockrell, Jr. | 252/547 |
| 4,260,513 | 4/1981 | Lamberti et al. | 252/174.19 |
| 4,828,569 | 5/1989 | Heath et al. | 252/153 |
| 4,836,950 | 6/1989 | Madsen et al. | 252/153 |
| 5,085,795 | 4/1992 | Narayanan et al. | 252/162 |
| 5,102,573 | 4/1992 | Han et al. | 252/153 |

FOREIGN PATENT DOCUMENTS 0286075 10/1988 European Pat. Off. .

*Primary Examiner*—Paul Lieberman
*Assistant Examiner*—Erin M. Higgins
*Attorney, Agent, or Firm*—Hugh D. Jaeger

[57] ABSTRACT

An aqueous based cleaner-degreaser for removing oleophilic petroleum oils and greases from metal and metal alloys, such as aluminum and zinc, and has been developed employing a mixture of a quaternary phosphate, a ketone, a primary amine, and surfactant and surfactant builders comprised of primarily ethoxylated alcohols. Further, the solution functions at a pH less than 10.5, and exhibits very low toxicity compared to solvent or basic cleaning solutions.

3 Claims, No Drawings

AQUEOUS BASED CLEANER-DEGREASER

BACKGROUND OF THE INVENTION

1. Field of the Invention

The present invention incorporates a mixture of components which improves emulsification efficiency and corrosion inhibition of fully aqueous cleaners and degreasers commonly used.

2. Description of the Prior Art Cleaning

Cleaning solutions employed in the washing of auto engine parts, industrial equipment and machine shop output are largely compounded by materials observed to be "dangerous substances" per Notice 147, issued by the EPA, and/or classified as "toxic substances" per 40 C.F.R. para. 372.65. Of the common solutions employed, those suitable for metals and metal alloys sensitive to corrosion are flammable, and aqueous cleaners which are non-flammable are sufficiently corrosive to preclude use with aluminum, zinc and steel.

Ketones such as n-methyl pyrolidone and gammabutyrolactone have been employed for some time as replacements for aromatic and chlorinated solvents used in many cleaning operations. It has been discovered that these ketones improve emulsification of oils and grease by ethoxylated alcohols through accelerated penetration or "softening". Prior to the present invention, this was commonly achieved with solvents such as stoddard solvent or strong bases such as sodium hydroxide, ammonium hydroxide, etc.

SUMMARY OF THE INVENTION

In general, emulsification involves use of a component which exhibits solubility in both water and oils. For example, alkane groups are fat soluble, which when reacted with aluminum chloride and benzene, alkylate the benzene ring. Upon sulfonation, the alkylated benzene sulfonate exhibits hydrophobic solubility at the alkane chain and hydrophilic solubility at the sulfonate.

The difficult aspect of this mechanism in the context of a cleaner is the development of a cleaner which will emulsify fats and oils, but is sufficiently weak to not overcome the tendency of the fats and oils to conglomerate when in the same vicinity.

The problems of the prior art have been overcome by the instant invention, which provides a cleaner which operates at low pH, is fully aqueous, does not exhibit a high flash point, and has low toxicity to operators and the environment. The cleaner is characterized in that grease and oils will separate therefrom for removal once agitation is ceased. Accordingly, the material is recyclable and partially recoverable for further use, as the non-water soluble oil layer will separate after agitation has ceased, and can be put to further use such as a secondary fuel supplement in cement film furnaces.

Significant aspects and features of the present invention include that the cleaner operates at a pH less than 10.5, is fully aqueous, has a low toxicity to operators and the environment, oils and greases will separate for removal once agitation has stopped for recyclability, and does not exhibit a high flash point.

Another significant aspect and feature of the present invention is that the formulation also lends itself to use as an all-purpose cleaner, and with thickeners added, as a hand cleaner.

A further significant aspect and feature of the present invention is a very desirable solution which is very miscible with ordinary water, and rinses away the emulsified oils.

Another significant aspect and feature of the present invention is that there are no odors, hazardous or toxic, when heated.

Yet another significant aspect and feature of the present invention is that it recycles in the field and separates by itself.

Another significant aspect and feature of the present invention is that it can be used in garage parts cleaners.

DESCRIPTION OF THE PREFERRED EMBODIMENTS

One proposed formulation by weight with the balance water is:

| | |
|---|---|
| a. Tetrapotassium pyrophosphate (quaternary phosphate) | 4% |
| b. gamma-butyrolactone | 10% |
| c. monoethanol amine (primary amine) | 4% |
| d. phosphorylated non-ionic organo phosphate ester | 12% |
| e. ethoxylated alcohol - primary | 3% |
| f. sodium alkylbenzene sulfonic acid | 3% |
| g. poly (oxyethylene/oxypropylene) glycol | 0.84% |

A second proposed formulation by weight in water is the following ranges for each of the components a–g:

| | |
|---|---|
| a. Tetrapotassium pyrophosphate | 2–10% |
| b. gamma-butyrolactone | 5–40% |
| c. monoethanol amine | 1–10% |
| d. phosphorylated non-ionic organo phosphate ester | 1–15% |
| e. ethoxylated alcohol - primary | 3% |
| f. sodium alkylbenzene sulfonic acid | 1–7% |
| g. poly (oxyethylene/oxypropylene) glycol | 0.1–2% |

A third proposed formulation by weight in water is the following ranges for each of the components a–g:

| | |
|---|---|
| a. Tetrapotassium pyrophosphate (quaternary phosphate) | 2–10% |
| b. gamma-butyrolactone | 5–40% |
| c. monoethanol amine (primary amine) | 1–10% |
| d. phosphorylated non-ionic organo phosphate ester | 1–15% |
| e. ethoxylated alcohol - primary | 3% |
| f. sodium alkylbenzene sulfonic acid | 1–7% |
| g. poly (oxyethylene/oxypropylene) glycol | 0.1–2% |
| h. a triazole derivative such as tolyl triazole .05–1% by weight. | |

Although tetrapotassium pyrophosphate is preferred, other pyrophosphates and phosphates can be used without departing from the spirit and scope of the invention, such as tetrasodium pyrophosphate. Primary and secondary phosphates may also be used.

Suitable ketones include n-alkyl pyrolidones, wherein the alkyl group is perferably a $C_1$ to $C_{12}$ alkyl group, most preferably methyl, octyl or dodecyl, and gammabutyrolactone having one of the following structures:

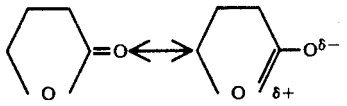

The gamma-butyrolactone will react with monoethanol amine to form N(p-hydroxyethyl) pyralidane. This reaction takes place at temperatures of 70°-80° at yields of 50-80%. Thus, additions of a pyralidine are not necessary. The reacted pyralidone functions to further enhance the penetration of high molecular weight petroleum products.

MODE OF OPERATION

The cleaner-degreaser solution is prepared in the following manner. Components a, b and c are first mixed in a vat with the appropriate amount of water. Components d, e, f and g are then mixed in a second vat in the order of component f, e, d, and g. The solution of the second mixing vat is then added to the solution of the first mixing vat.

For cleaning/degreasing, the thus prepared solution is subjected to constant agitation. When agitated, the fat and oil particles are maintained apart. When agitation ceases, the particles characteristically having specific gravities less than that of water conglomerate at the surface, and thus can be separated. During the oil removal process, sulfonates such as sulfonic acid will free hydrophobic/hydrophilic components and aid in the separation.

Mixing can be accomplished by any suitable means, such as by standard propeller mixers. Preferably the mixer shell is coated with polypropylene or polyethylene.

Various modifications can be made to the present invention without departing from the apparent scope hereof.

We claim:

1. Aqueous based-cleaner degreaser, the formulation consisting essentially of:

| | | |
|---|---|---|
| a. | Tetrapotassium pyrophosphate | 4% |
| b. | gamma-butyrolactone | 10% |
| c. | monoethanol amine | 4% |
| d. | phosphorylated non-ionic organo phosphate ester | 12% |
| e. | ethoxylated alcohol-primary | 3% |
| f. | sodium alkylbenzene sulfonic acid | 3% |
| g. | poly(oxyethylene/oxypropylene) glycol | 0.84% |
| h. | the balance being water | |

2. A method of preparing an aqueous based-cleaner degreaser, comprising:

a. mixing in a first vessel in an aqueous medium a quaternary phosphate selected from the group consisting of tetraalkalimetal pyrophosphates, a ketone selected from the group consisting of n-alkyl pyrolidones (wherein the alkyl group is from $C_1$ to $C_{12}$) and gamma-butyrolactone, and monoethanolamine to form a first mixture;

b. mixing in a second vessel an alkali metal alkylbenzene sulfonic acid, a primary ethoxylated alcohol, a phosphorylated non-ionic organo phosphate ester and a poly (oxyethylene/oxypropylene) glycol by forming a second mixture by adding said ethoxylated alcohol to said sulfonic acid and mixing; adding said phosphorylated non-ionic organo phosphate ester to said second mixture and mixing to form a third mixture, and adding said poly (oxyethylene/oxypropylene) glycol to said third mixture and mixing to form a fourth mixture; and, c. adding to said first mixture said fourth mixture and mixing to form a fifth mixture.

3. The method of claim 2 wherein said alkali metal alkylbenzene sulfonic acid is sodium or potassium alkylbenzene sulfonic acid.

* * * * *